US007811138B2

(12) United States Patent
Santangelo et al.

(10) Patent No.: US 7,811,138 B2
(45) Date of Patent: Oct. 12, 2010

(54) ELECTRICAL CONNECTOR FOR SURGICAL SYSTEMS

(75) Inventors: Stephen Santangelo, Wallingford, CT (US); Stephen Maguire, Shelton, CT (US)

(73) Assignee: Pioneer Surgical Technology, Inc., Marquette, MI (US)

( * ) Notice: Subject to any disclaimer, the term of this patent is extended or adjusted under 35 U.S.C. 154(b) by 0 days.

(21) Appl. No.: 12/396,249

(22) Filed: Mar. 2, 2009

(65) Prior Publication Data

US 2009/0221153 A1 Sep. 3, 2009

Related U.S. Application Data

(60) Provisional application No. 61/032,451, filed on Feb. 29, 2008.

(51) Int. Cl.
*H01R 4/30* (2006.01)

(52) U.S. Cl. ..... 439/728

(58) Field of Classification Search ..... 439/728, 439/835; 600/219, 221, 546
See application file for complete search history.

(56) References Cited

U.S. PATENT DOCUMENTS 5,474,558 A * 12/1995 Neubardt ..... 606/79
6,074,241 A * 6/2000 Patel et al. ..... 439/441
6,564,078 B1 5/2003 Marino et al.
7,207,949 B2 4/2007 Miles et al.
7,607,956 B2 * 10/2009 Lang et al. ..... 439/835
2004/0225228 A1 11/2004 Ferree
2005/0075578 A1 4/2005 Gharib et al.
2005/0149035 A1 7/2005 Pimenta et al.
2005/0182454 A1 8/2005 Gharib et al.
2006/0025703 A1 2/2006 Miles et al.
2007/0016097 A1 * 1/2007 Farquhar et al. ..... 600/546
2007/0021682 A1 1/2007 Gharib et al.
2007/0100212 A1 5/2007 Pimenta et al.
2007/0208227 A1 * 9/2007 Smith et al. ..... 600/219
2008/0221473 A1 * 9/2008 Calancie et al. ..... 600/546

* cited by examiner

*Primary Examiner*—Jean F Duverne
(74) *Attorney, Agent, or Firm*—Fitch, Even, Tabin & Flannery

(57) ABSTRACT

An apparatus for creating an electrical connection with a surgical tool is provided that is capable of engaging the shafts of rotatable surgical tools having varying diameters. In one aspect, the apparatus includes a body of nonconductive material connected to a pair of spaced, electrical contact members that provide two spaced points of contact with the tool shaft. In another aspect, a contact arm is provided which pivots within a slot formed within a housing to receive larger diameter tool shafts. Additionally, the contact arm closes an opening on the housing and resiliently shifts to an open position as the contact arm is brought into engagement with the tool shaft. A method of connecting a conductor assembly to a rotatable tool shaft is also provided which includes using tension in the conductor assembly to resist rotation of a gripping end of the assembly connected to a rotatable tool.

19 Claims, 12 Drawing Sheets

ELECTRICAL CONNECTOR FOR SURGICAL SYSTEMS

CROSS-REFERENCE TO RELATED APPLICATIONS

This application claims priority to U.S. Provisional Patent Application Ser. No. 61/032,451, filed Feb. 29, 2008, which is hereby incorporated by reference as if fully set forth herein.

FIELD OF THE INVENTION

The invention relates to an apparatus and method for creating an electrical connection with a surgical tool and, more particularly, to a device capable of engaging the shafts of rotatable surgical tools having varying diameters to establish an electrical connection therewith.

BACKGROUND OF THE INVENTION

Minimally invasive surgery has become increasingly prevalent in spinal surgeries to correct a variety of spinal irregularities and injuries. Traditionally, surgeons relied upon "open" surgical techniques to access different areas of the spine. "Open" surgical techniques require a single, long incision along a patient's skin adjacent the spine followed by retraction of muscles and tissues to expose the surgical field. Minimally invasive surgery, on the other hand, utilizes a number of smaller incisions to provide access to the spine with tools being inserted through the incisions to perform the surgery. As a result, minimally invasive procedures often produce smaller scars, less tissue damage, and reduced recovery times. However, one problem with minimally invasive surgery is that the smaller incisions limit a surgeon's view of the surgical field. This requires the surgeon to rely to a greater extent on tactile feedback from surgical tools during surgery.

One application of minimally invasive surgery that has gained widespread acceptance is in spinal fusion procedures. As used herein, the term fusion refers to the joining of materials, such as bone or graft material, and the fusion site is the entire region in which fusion may be desired. Trauma or disease may cause instability in the spine that generates painful contact between spinal structures and elements of the nervous system. One method of correcting the instability is to secure a spinal rod near the problem area to fuse nearby vertebrae together and restore alignment of the vertebrae within the spinal column. Typically, screws are inserted into the pedicles of the target vertebrae before being secured to the spinal rod to fix the vertebrae relative to each other.

Because the pedicle is a relatively narrow structure of the vertebra, it is important that a hole drilled into the pedicle be centrally aligned along the pedicle. Misalignment of the pedicle screw produces a weakened connection between pedicle screw and the pedicle bone. Moreover, deviation from the pedicle axis during pilot hole drilling or insertion of the pedicle screw may puncture the vertebral cortex and damage adjacent nerve roots or the spinal cord.

Numerous techniques exist to aid a surgeon during installation of the pedicle screw when the surgical field is obstructed, such as during minimally invasive surgeries. One common approach relies upon the electrically conductive properties of the nervous system to measure the proximity of medical instruments to nerves by using an electrical signal. In use, the patient is placed under anesthesia and connected to an electromyograph (EMG) machine to monitor muscle contractions. The connection with the EMG machine typically comprises a collection of electrodes placed on a patient's skin.

The electrodes are positioned to monitor major muscle groups connected to the nerve roots adjacent the surgical site. Because the patient is under anesthesia, the muscles being monitored should not normally contract. However, if the muscles are stimulated by an electrical signal and contract, the EMG machine will generate an audio or visual signal to warn the surgeon of the unexpected muscular activity.

The surgeon then connects an electrical signal generator such as from the EMG machine to a metallic tool, such as a drill or an awl, to be used during surgery. The signal generator energizes the tool so that when the tool is brought into proximity with a nerve root, electrical current will flow into the nerve root and cause the muscles associated with the nerve root be stimulated to contract. The EMG machine senses the muscle activity and provides an auditory and visual signal to alert the surgeon of the proximity of the tool to the nerve root. In this manner, the process supplements the surgeon's tactile feedback during surgery and reduces the likelihood of contacting nerves with the energized tool.

For example, when a surgeon uses this procedure to drill a pilot hole for a pedicle screw, there is typically no electrical communication between the energized tool and the adjacent nerve roots due to the insulating characteristics of bone. However, if the drill breaches the vertebral cortex, the electrical current directed through the drill shaft reaches the adjacent nerve root. The electrical current then travels along the nerve and causes the associated muscle to contract. At this point, the EMG machine would observe the muscle contraction and provide auditory and visual notification to the surgeon that the pedicle has been compromised. At this point, the surgeon will likely select a different installation location. Accordingly, this procedure improves the precision of pedicle screw installations even when the surgeon cannot directly view the surgical site.

For electrically connecting the EMG machine to the rotatable tool shaft, an electrical lead extending from the machine is attached at its free end to the shaft by an electrically conductive clip, such as an alligator-type clip. However, the clip is substantially fixed onto the tool shaft. Thus, when the surgeon rotates the tool shaft, the clip rotates therewith causing the wire to wrap around the rotating shaft. Such wire wrapping entangles the wire on the shaft and, depending on the amount of play in the electrical lead between the EMG machine and the tool shaft, may inhibit rotation of the shaft as well as potentially breaking the electrical connection between the machine and tool shaft.

Accordingly, there is a need for an improved connector between nerve monitoring equipment and a variety of rotatable tools used during surgery.

SUMMARY OF THE INVENTION

In accordance with one aspect of the invention, a device for creating an electrical connection between a nerve monitoring device and a tool having a metallic shaft is provided that utilizes conductive members that have a small conductive contact area with the tool shaft so as to optimize rotation of the tool shaft. In this regard, the device has a body formed of a nonconductive material having a bearing surface for engaging the rotatable tool shaft. An elongate flexible conductor is connected at one end to the body and at a second end to the nerve monitoring device. A pair of spaced, electrical contact members of conductive material are connected to the body. The electrical contact members are configured to each have point contact with the tool shaft and provide two spaced points of contact against the tool shaft. Accordingly, the present device limits friction between the device and the tool shaft by electrically contacting the tool shaft and the two spaced point contacts via the electrical contacts.

In another aspect of the invention, a device for providing an electrical connection to tools having shafts of varying diameters is provided. The device includes a rigid housing having a support surface for engaging a tool shaft, and a resilient mounted electrical contact arm that allows for varying diameters of tool shafts to be fit between the contact arm and the support surface. The housing also includes a slot so that with larger diameter tool shafts, e.g., bone awls, the arm can be resiliently shifted into the clearance space provided by the slot for fitting the larger diameter shafts between the contact arm and the housing support surface. More particularly, the contact arm of conductive material urges the tool shaft against the support surface to securely hold the tool between the rigid housing support surface and the contact arm. To connect the contact arm and the rigid housing, a resilient pivot connection may be used which allows the contact arm to resiliently pivot and engage tool shafts of varying diameters. The contact arm pivots within a slot formed in the housing and beyond the housing for tool shafts of larger diameters. By permitting the contact arm to pivot beyond the housing, the device may engage a greater range of tool shaft diameters than if the contact arm were limited to pivoting within the housing. Moreover, the resilient pivoting of the contact arm securely holds the device on the tool shaft. This simple operation allows a surgeon to quickly connect the device and provides a secure connection to a variety of shaft sizes of rotatable tools.

In another aspect, an electrical connection head for being connected to a rotatable tool shaft is provided that allows for an easy one-handed operation to be used for attaching the electrical connection head to the tool shaft. The electrical connection head includes a rigid housing having a support surface and an opening of the housing sized for receiving a tool shaft. The connection head also includes a contact arm that is resiliently mounted to the housing so that the contact arm extends across the housing opening when the contact arm is in a closed position. The contact arm resiliently shifts to an open position as the contact arm is brought into engagement with the tool shaft so that the contact arm is shifted to an open position. This open position allows the tool shaft to be received through the housing opening and to be biased into engagement with the support surface by the resiliently shifted contact arm. In this manner, a user may attach the electrical connection head to the tool shaft using only a one-handed operation.

A method of connecting a conductor assembly to a rotatable tool shaft is also provided and includes flexibly connecting one end of the conductor assembly to a substantially fixed location, such as a nerve monitoring device. The method also includes connecting an opposite gripping end of the conductor assembly to the rotatable tool shaft so that an elongate flexible conductor of the conductor assembly extends loosely between the opposite ends. Additionally, the method includes tensioning a portion of the elongate flexible conductor extending between the gripping end and an intermediate location on the flexible conductor, so that the tension of the flexible conductor portion resists rotation of the gripping end of the conductor assembly connected to the tool shaft as the tool shaft is rotated. In a preferred form, the portion of the elongate flexible conductor is tensioned by clipping the intermediate location to a fixed structure.

DETAILED DESCRIPTION OF THE PREFERRED EMBODIMENTS

Figure 1:
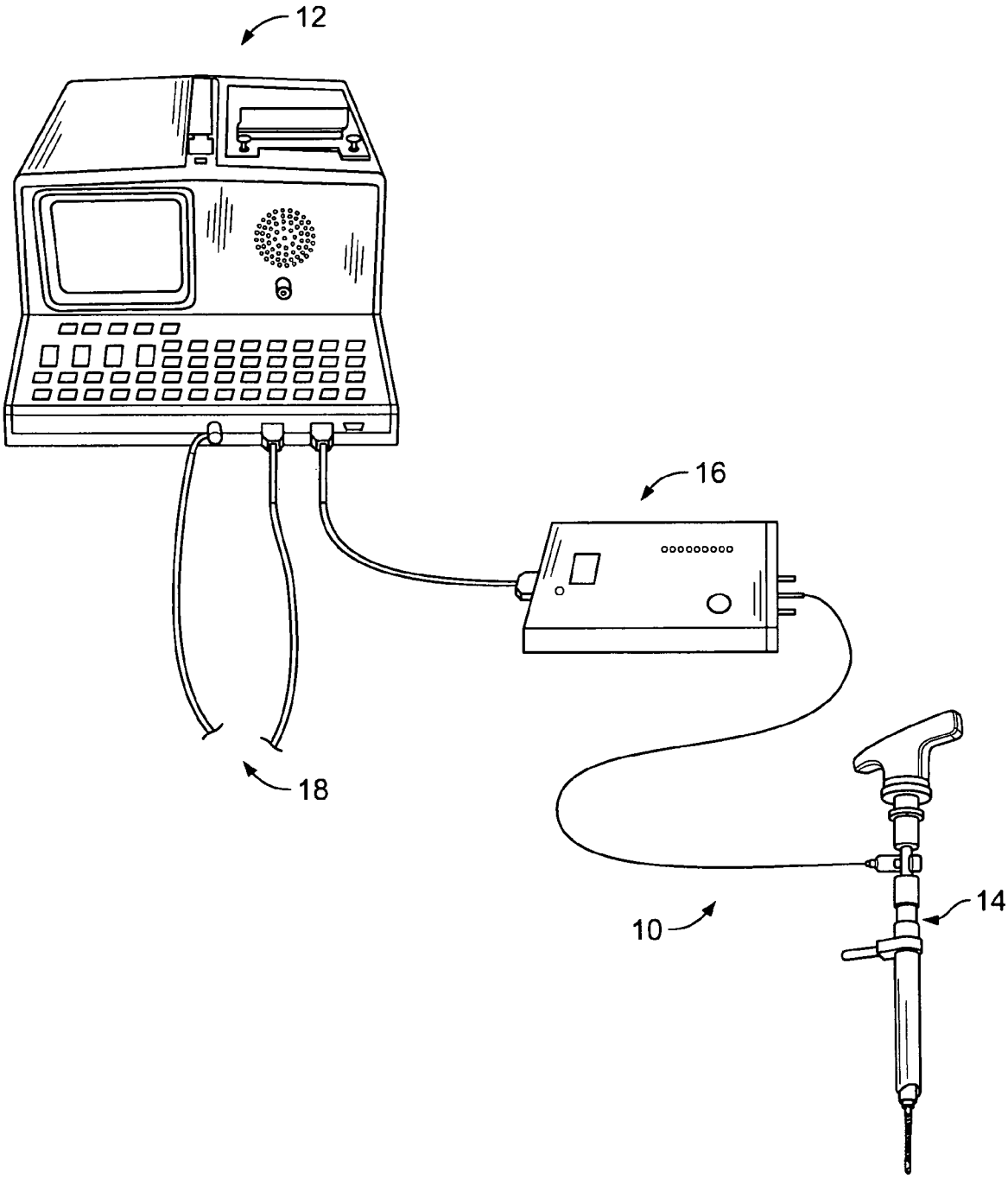
FIG. 1 is a schematic view of a nerve monitoring system including a monitoring device, a signal generator, an electrical connector, and a rotatable surgical tool.

In FIG. 1, an electrical connector 10 for connecting a nerve monitoring device 12 to a surgical tool 14 is shown. The tool 14 has a metallic shaft capable of conducting an electrical charge. The tool 14 may be a drill, tap, screwdriver, dilator, pedicle probe, pedicle finder, or any other surgical tool capable of conducting an electrical charge. Additionally, the tool 14 may be rotated during use, or may be used in a generally linear manner. With respect to rotatable tools, the electrical connector 10 provides a connection thereto that permits the tool 14 to rotate while the electrical connector 10 remains relatively stationary.

The nerve monitoring device 12 is used to alert an operating surgeon when the tool 14 comes into proximity with a major nerve within the patient's body. To this end, a signal generator 16 provides an electrical signal through electrical connector 10 to energize the tool 14. In an alternative configuration not shown, the nerve monitoring device 12 has signal generating capacity so that the monitoring device 12 energizes the tool 14 directly without the use of the signal generator 16. Regardless of the configuration, if the energized tool 14 approaches a nerve root, the electrical signal will be transmitted to a corresponding group of muscles and cause the muscles to contract. The nerve monitoring device 12 includes an input 18 for receiving signals relating to the muscular contractions. In a preferred embodiment, the nerve monitoring device 12 is an electromyograph (EMG) machine configured to monitor muscle contractions in the group of muscles stimulated by the electrical signal. The input 18 would preferably include sensors placed onto the skin near the group of muscles.

Figure 2:
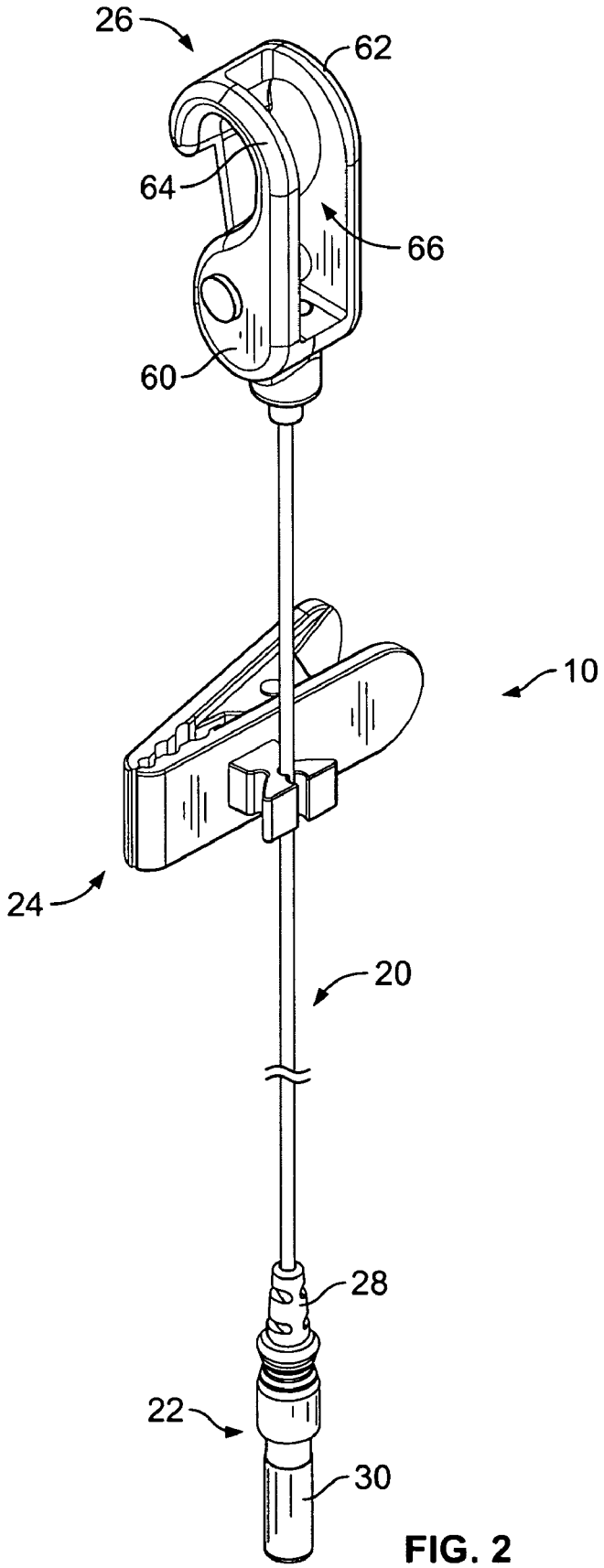
FIG. 2 is a perspective view of the electrical connector including features in accordance with the present invention showing a housing, an electrical conduit, a plug, and a clip positioned along the length of the electrical conduit.

The electrical connector 10 generally comprises an electrical conduit 20, a plug 22, a clip 24, and a housing end 26, as shown in FIG. 2. The electrical conduit 20 is relatively thin and lightweight to limit restrictions on movement of the tool 14 during surgery. The electrical conduit 20 comprises an interior conductor within an exterior insulator to limit electrical signals traveling along the electrical conduit 20 from being conducted away from the tool 14. In a preferred configuration, silver-plated cadmium copper serves as the conductor and PVC plastic insulates the conductor within the electrical conduit 20.

The plug 22 is configured to provide an electrical connection between the electrical connector 10 and the signal generator 16. Within the plug 22, a metallic connector (not shown) is joined to the interior conductor of the electrical conduit 20 to provide a mechanical and electrical connection between the interior conductor and the signal generator 16. The metallic connector and the electrical conduit are joined together in a semi-permanent manner, such as by soldering or crimping. The resulting connection is then over-molded with an insulating material that extends over the electrical conduit insulator. In a preferred form, the metallic connector is a standard 1.5 mm female DIN plug, and a tin-coated brass crimp is plastically deformed over a portion of the metallic connector and conductor of the electrical conduit 20 before being over-molded with PVC plastic. A flexible sleeve 28 overlies a length of the electrical conduit 20 and acts as a stress relief by restricting the electrical conduit 20 from bending at a sharp angle relative to the plug 22. The plug 22 also includes a tip 30 shaped to house the metallic connector and engage a corresponding connection on the signal generator 16.

Figure 3:
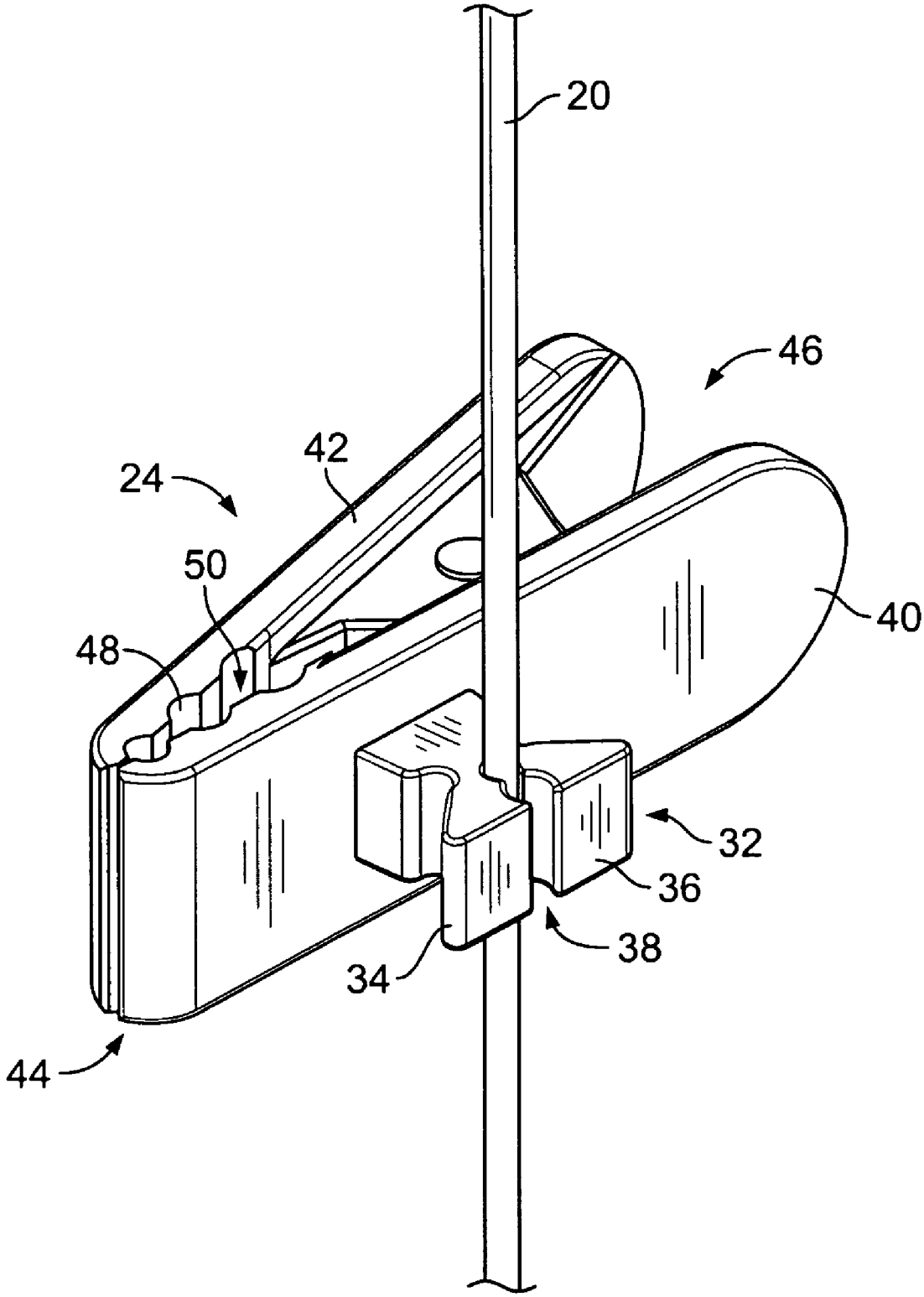
FIG. 3 is a perspective view of the clip showing a fastening structure for securing the clip along the electrical conduit.

Clip 24 is configured to fix a portion of the electrical conduit 20 to an object, as shown in FIG. 3. Clip 24 is releasably attached to any point along the electrical conduit 20 via a fastening structure 32 with resilient prongs 34, 36. The prongs 34, 36 have semi-circular structures that define a channel 38 with two diameters. The larger diameter area acts as a bearing surface for the electrical conduit 20, such that when the electrical conduit 20 is seated within the larger diameter area, further pressing the electrical conduit 20 toward the smaller diameter area causes the prongs 34, 36 to spread apart. Once the electrical conduit 20 is received in the smaller diameter area, the resilient prongs collapse against the electrical conduit 20 to hold the electrical conduit 20 fixed within the fastening structure 32. At the other end of the fastening structure 32, a pivot connection (not shown) is positioned between the fastening structure 32 and one of the opposing contact members 40, 42. The pivot connection permits pivoting of the clip 24 relative to the electrical conduit 20 while maintaining the fixed connection between the fastening structure 32 and the clip 24. In a preferred embodiment, a bore is formed in contact member 40 and a snap-fit structure on the fastening structure 32 extends into the bore, such that the clip 24 is easily assembled during manufacture.

The clip 24 includes an internal spring (not shown) to urge the opposing contact members 40, 42 into clamping engagement at a first end 44. To attach clip 24 onto an object, a surgeon presses the contact members 40, 42 together at a second end 46 to overcome the resilient force of the internal spring. This separates the contact members 40, 42 and creates an open end that may be placed onto the object. The clip 24 may fix the portion of the electrical conduit 20 to nearly any object near the surgical field, including without limitation, a surgical drape, an article of clothing, a wire, a structural member of an operating table or gurney, another surgical tool, or any other structure or position the surgeon finds useful. The contact members 40, 42 include contact surfaces 48, 50 that may include structures for providing a more secure connection between the clip 24 and the object. In the illustrated embodiment, the contact surfaces 48, 50 have semi-circular channels formed therein which improve the ability of clip 24 to securely engage objects with a curved cross-section, such as round wire or folded fabric.

Figure 4:
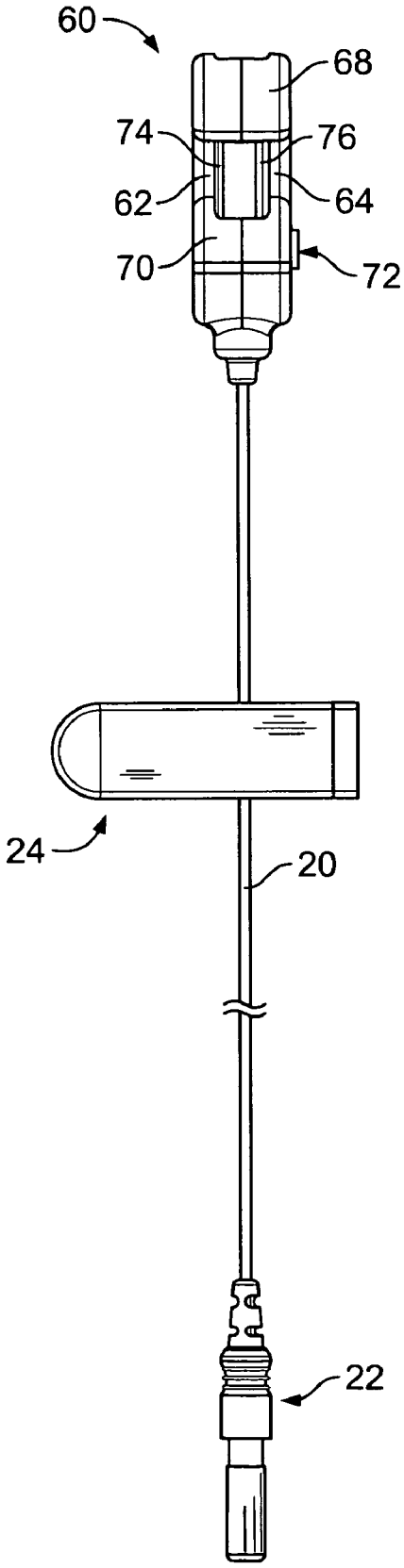
FIG. 4 is a side view of the electrical connector of FIG. 2 showing parallel, elongate members extending across an opening formed in the housing.

Referring briefly again to FIG. 2, housing end 26 includes a housing 60 having two hook-shaped arms 62, 64 positioned on either side of a slot 66. Turning now to FIG. 4, a curved cross member 68 extends between distal ends of the hook-shaped arms 62, 64, while a front section 70 connects proximal ends of the arms adjacent a pin 72. The pin 72 is generally cylindrical and functions to retain a resilient pivot connection within the housing 60, as will be discussed in more detail below. The pin 72 is preferably held within holes formed in both hook-shaped arms 62, 64 using a press fit connection, but may alternatively be held within the arms 62, 64 by threading, welding, or chemical bonding. Both the housing 60 and pin 72 are made from a rigid material that provides structure to the housing end 26. Additionally, the material should be electrically insulating to restrict electrical current from conducting away from the tool 14. The material selected should also permit sterilization using heat or radiation, be impact resistant for durability purposes, and be lightweight. The preferred material is polycarbonate sold under the name Noryl® 731-7982S.

Figure 7:
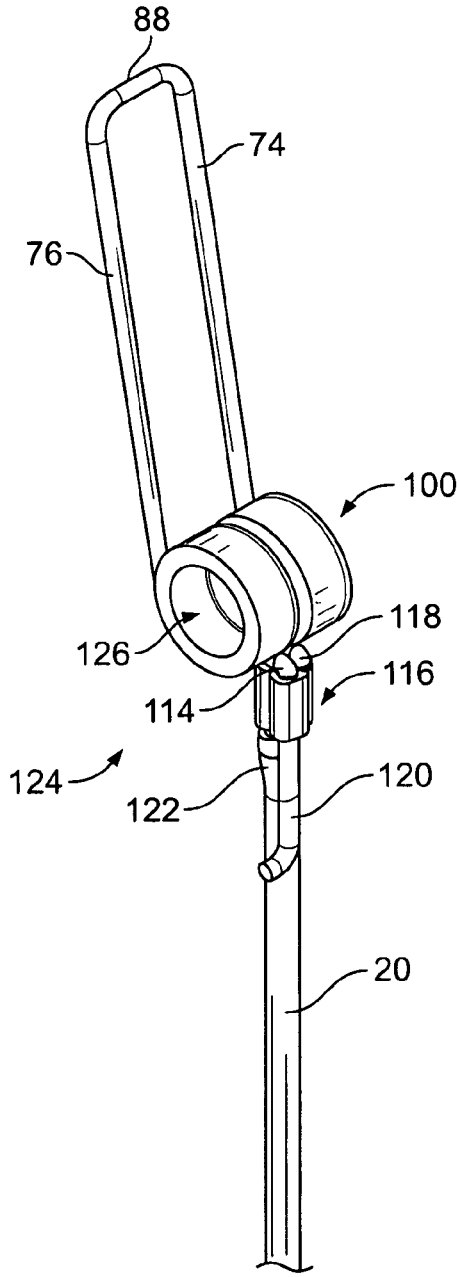
FIG. 7 is a perspective view of a subassembly of the electrical connector of FIG. 2 showing the connection between the elongate members and the electrical conduit.

As shown in FIGS. 4 and 7, the housing end 26 includes a pair of spaced, elongate members 74, 76 connected to the housing 60 and positioned between the hook-shaped arms 62, 64. The elongate members 74, 76 are thin and generally straight, and may extend parallel to each other. The cross sections of the elongate members 74, 76 may be circular, rectangular, or any other shape conducive to manufacture. The elongate members 74, 76 are made from an electrically conductive material and contact the shaft of a surgical tool received within the housing 60. The elongate members 74, 76 provide an electrical connection between the electrical conduit 20 and the tool shaft, as will be discussed in more detail below. The electrical connection between the elongate members 74, 76 and the tool shaft comprises direct physical contact so that electrical signals may conduct between the members 74, 76 and the tool shaft. In a preferred embodiment, the elongate members 74, 76 are made from stainless steel to provide a low resistance to electrical current.

The elongate members 74, 76 securely engage the housing 60 to the tool shaft by resiliently urging the tool against an interior surface of the housing 60 to hold the tool within the housing 60. The elongate members 74, 76 pivot backward between the hook-shaped arms 62, 64, when a tool is inserted into contact with the elongate members 74, 76. In this manner, the pivoting permits the elongate members 74, 76 to accommodate tool shafts of varying diameters while providing a secure connection between the housing 60 and the tool. Additionally, the elongate members 74, 76 may fit within corresponding features on the tool, such as grooves, slots or protrusions. When the elongate members 74, 76 rest within these features, the contact of the elongate members 74, 76 against the features restricts movement of the elongate members 74, 76, and thus the housing 60, along the length of the tool.

Figure 5:
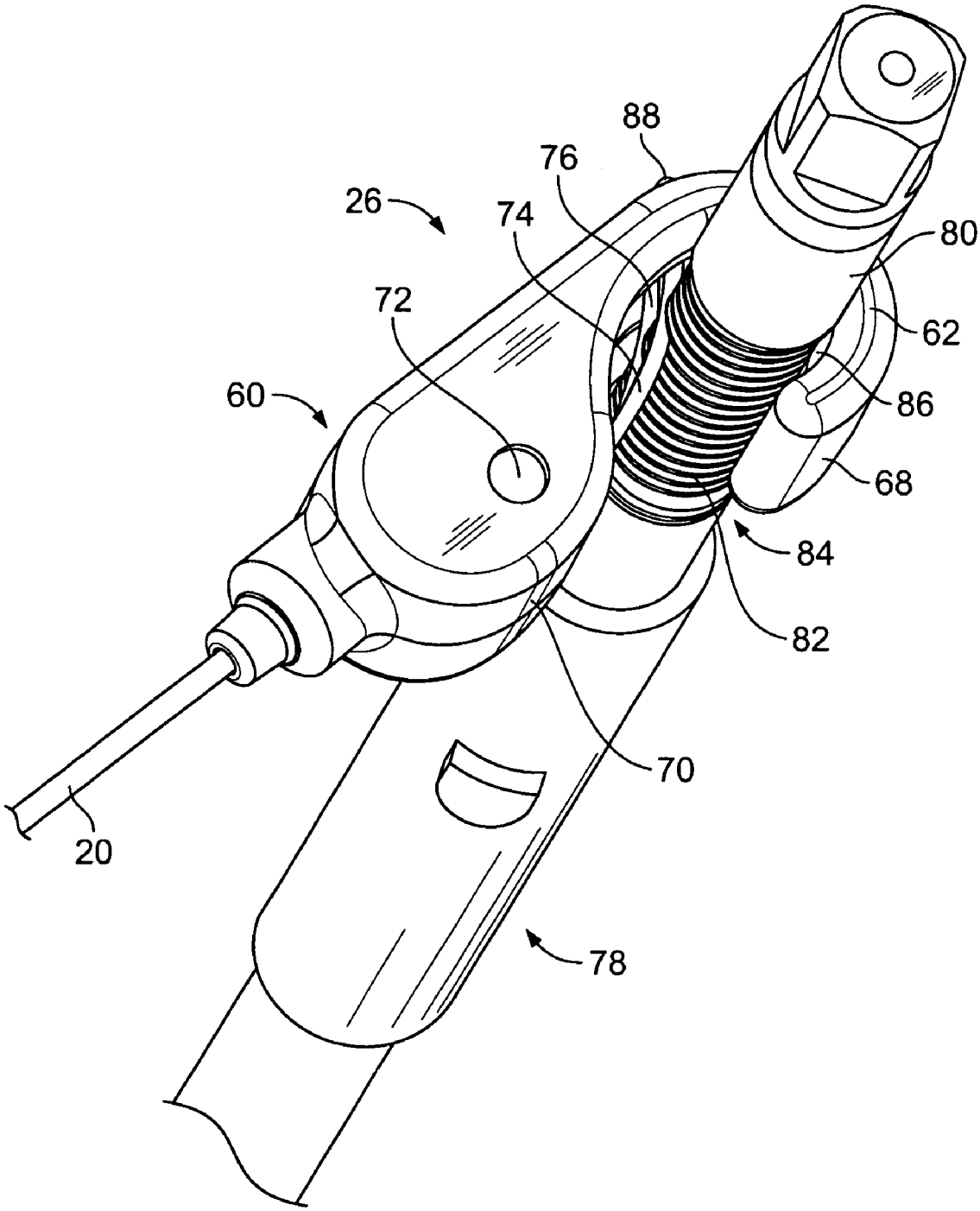
FIG. 5 is a perspective view of the electrical connector of FIG. 2 showing engagement of the housing with a rotatable tool and the elongate members mating with grooves formed on the shaft of the tool.

By way of example, the housing end 26 is configured to receive an awl 78 having a shaft 80 with grooves 82 formed therein, as shown in FIG. 5. The awl 78 is inserted into the housing 60 through an opening 84 between front section 70 and the ends of hook-shaped arms 62, 64. The hook-shaped arms 62, 64 include a support surface 86 within the housing 60 that extends along the length of the hook-shaped arms 62, 64. The arms 62, 64 are shaped to extend around the tool shaft 80 and contact the shaft 80 along a section of the circumference of the tool shaft 80. Because the hook-shaped arms 62, 64 are separated along a portion of their length by slot 66, the support surface 86 comprises a surface along each of the hook-shaped arms 62, 64 until the arms 62, 64 join at curved cross member 68. At the interior of curved cross member 68, the support surface 86 comprises a single, wide surface for supporting the awl shaft 80 when the housing 60 engages the awl 78. Thus, the awl shaft 80 may be in contact with the support surface 86 formed on the interior of each hook-shaped arm 62, 64 as well as the support surface 86 formed on the interior of the curved cross member 68. Moreover, the support surface 86 is oriented parallel to the length of the awl 78 such that the support surface 86 forms a smooth, curved surface that is complimentary to the curvature of the outer surface of the awl shaft 80.

When the awl 78 is received within the housing 60, the elongate members 74, 76 urge the awl shaft 80 against the support surface 86. The support surface 86 is preferably a generally arcuate configuration that extends about an axis, with the elongate members 74, 76 extending transverse to the axis so that the elongate members 74, 76 urge the awl shaft 80 into abutting contact with the curved support surface 86. Although the curvature of the support surface 86 may be larger than the curvature of the shaft 80, the pivoting movement of the elongate members 74, 76 permits the members to urge the shaft 80 against the support surface regardless of the diameter of the shaft 80. Therefore, the contact between the shaft 80 and the support surface 86 is effectively that of a cylinder against a concave surface extending along the outer surface of the cylinder. This contact is generally a line of contact along the length of the awl shaft 80. Even where the support surface 86 is bisected by the slot 66, the contact between the support surface 86 and the shaft 80 is that of a cylinder against two concave surfaces extending along the length of the shaft 80. The two areas of contact are each effectively a line of contact, with the areas being generally aligned along the shaft 80. The areas of contact between the support surface 86 and the shaft 80 are not materially affected by the presence of grooves 82 or other features formed in the shaft 80. Instead, the support surface 86 will extend across the features, creating a line of contact along several areas on the shaft 80.

A different type of contact exists between the elongate members 74, 76 and the awl shaft 80, as shown in FIG. 5. The elongate members 74, 76 are relatively thin and extend in a direction transverse to the length of the awl shaft 80. The orientation of the elongate members 74, 76 causes the members to tangentially contact the awl shaft 80. The contact between each elongate member 74, 76 is effectively a point of contact between a cylinder and a thin, long member extending transverse to the length of the cylinder that tangentially strikes the outer surface of the cylinder. Thus, the spaced configuration of the elongate members 74, 76 produces two spaced, point contacts against the awl shaft 80 that urge the awl shaft 80 against the support surface 86. As partially shown in FIG. 5, a cross bar 88 extends between the elongate members 74, 76 to provide rigidity against independent articulation of the members as well as to fix the distance between the two spaced, point contacts regardless of the diameter of the shaft 80. Further, the elongate members 74, 76 are sized to fit within grooves 82 formed on the shaft 80 and thereby resist movement of the housing 60 along the length of the awl 78.

Figure 6:
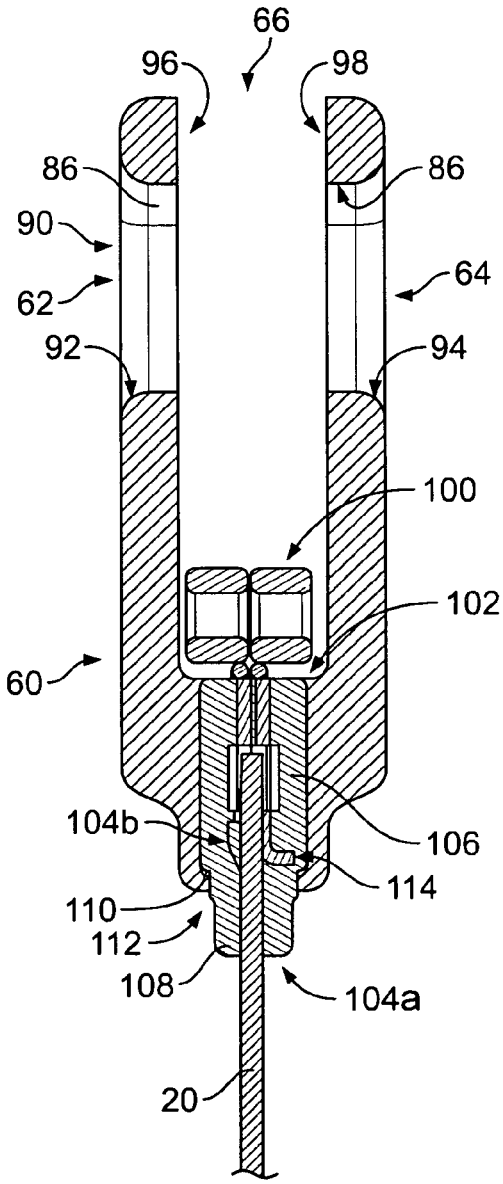
FIG. 6 is a cross-sectional view of the housing showing a pair of rigid arms on either side of a slot formed in the housing.

Referring now to FIG. 6, the housing end 26 is shown in greater detail by a cross-sectional view. More specifically, the hook-shaped arms 62, 64 of the housing 60 are positioned on opposite sides of the slot 66. The arms 62, 64 extend about an opening 90, with support surface 86 positioned on the interior of arms 62, 64 to support a tool shaft received within the opening 90. To improve the ease with which the housing end 26 may be connected to a tool, contoured surfaces 92, 94 may be disposed on the hook-shaped arms 62, 64 adjacent the opening 90. The arms 62, 64 further include spaced faces 96, 98 that are generally flat and define part of the slot 66.

Positioned between the faces 96, 98 is a resilient pivot connection 100 that joins elongate members 74, 76 to the housing 60, as well as provides an electrical connection between the members 74, 76 and the electrical conduit 20. The housing 60 includes an aperture 102 for receiving a deformable plug 104 that holds the resilient pivot connection 100 within the housing via a press fit engagement with the housing 60. To this end, the deformable plug 104 has a cross-sectional shape similar to the shape of aperture 102 so that deformable plug 104 may at least partially pass through aperture 102. Deformable plug 104 also includes a larger section 106 that overlies the connection between the resilient pivot connection 100 and the electrical conduit 20. A smaller section 108 projects beyond the housing 60 and overlies a portion of the electrical conduit 20. In between the larger and smaller sections 106, 108, an intermediate section 110 engages a smaller aperture ledge 112 of the housing 60 that restrains the larger section 106 of the deformable plug 104 from passing beyond the ledge 112. In one embodiment, the resilient pivot connection 100 includes an elongate bent member 114 that extends into the deformable plug 104 to keep the deformable plug engaged with the pivot connection 100. The deformable plug 104 is made from a non-conductive material that permits elastic deformation, such as a thermoplastic polyester elastomer. The preferred material for deformable plug 104 is sold under the name Riteflex® MT 9440.

The pivot connection 100 is joined to the conductor of the electrical conduit 20 in a manner that is electrically conductive, such as by soldering or crimping. One embodiment of this assembly is shown in FIG. 7, wherein the electrical conduit 20 includes an enlarged portion 122 of the insulator near the exposed end (not shown) of the conductor. A crimp 116 is plastically deformed over part of the pivot connection 100 to fix the pivot connection onto an exposed end of the electrical conduit 20. More specifically, the resilient pivot connection 100 includes an elongate bent member 114 and a short member 118 that both provide an elongate surface for engagement with crimp 116. Further, elongate bent member 114 has a straight portion 120 that extends along the electrical conduit 20 when the resilient pivot connection 100 is crimped onto the conduit 20. By positioning the elongate bent member 114 along the electrical conduit 20, the member 114 limits bending of the electrical conduit 20 within the housing 60. Additionally, the elongate bent member 114 extends the interface between the deformable plug 104 and the resilient pivot connection 100 beyond the crimp 116. The crimp 116 is preferably made from a metallic material, such as copper or stainless steel, which is electrically conductive and may be plastically deformed. Alternatively or in addition to crimp 116, the resilient pivot connection 100 may be joined to the electrical conduit through a soldered connection.

There are a variety of ways to assemble the resilient pivot connection 100, electrical conduit 20, and deformable plug 104 into the housing 60. One method involves passing the end of the electrical conduit 20 opposite the enlarged portion 122 through a bore 104*a* in the deformable plug 104 and into the aperture 102 in the housing 60. The electrical conduit 20 is advanced through the deformable plug 104 to position the plug 104 between the housing 60 and the enlarged portion 122. Next, the subassembly 124 shown in FIG. 7 is constructed by clamping the crimp 116 onto elongate bent member 114, short member 118, and the exposed end of the electrical conduit 20 to rigidly fix the components together. The deformable plug 104 is then slid over the subassembly 124 by drawing the larger section 106 first over the elongate bent member 114 and along the subassembly until the larger section 106 is positioned over the crimp 116.

At this point, the subassembly 124 is rigidly fixed together and electrically insulated by the deformable plug 104. Further, the larger section 106 of the deformable plug 104 covering the subassembly 124 has a larger cross-section than the aperture 102 in the housing 60. Thus, when the subassembly 124 is inserted through the aperture 102 and into the housing 60, the larger section 106 compresses against the subassembly 124. In this manner, the elastic properties of the deformable plug 104 permit a press fit engagement between the housing 60, the subassembly 124, and the deformable plug 104. However, the larger section 106 is too large to pass beyond the smaller aperture ledge 112 so the deformable plug 104, and thus the subassembly 124, are both restrained within the housing 60. Additionally, the deformable plug bore 104*a* includes a pocket 104*b* sized to match the enlarged portion 122 of the electrical conduit 20 when the conduit 20 is fully seated within the deformable plug 104. The pocket 104*b* therefore resists movement of the enlarged portion 122 in the direction of the aperture ledge 112 when the subassembly 124 is installed into the housing 60.

To complete assembly of the housing end 26, the pin 72 is inserted through a hole formed in one of the hook-shaped arms 62, 64, through an opening 126 in resilient pivot connection 100, and into a hole formed in the other hook-shaped arm 62, 64. The pin 72 effectively traps the resilient pivot connection 100 within the housing 60 and retains the subassembly 124 in the press fit engagement with the deformable plug 104 seated within aperture 102. As discussed above, the pin 72 is fixed within the housing 60 by a press fit connection, threading, or a variety of other methods.

Figure 8:
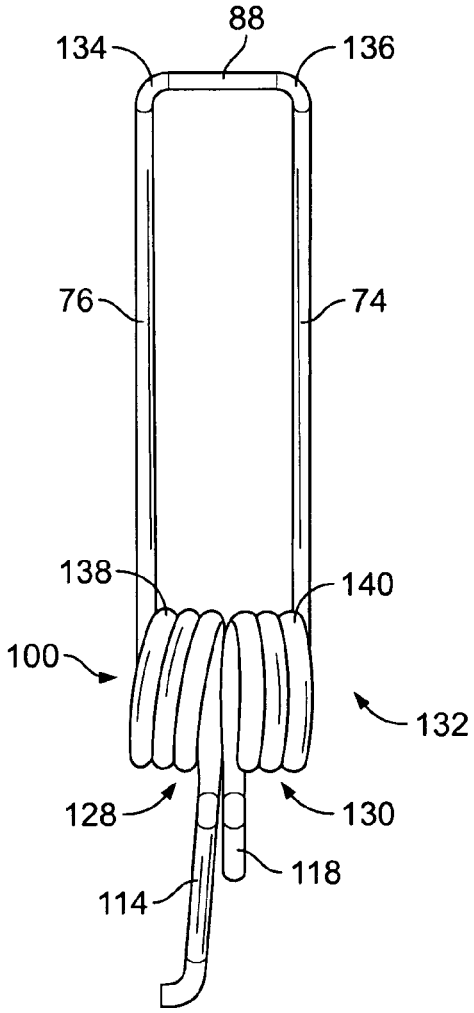
FIG. 8 is an enlarged, side view of a preferred embodiment of the resilient deflection subassembly showing torsion springs positioned between the elongate members.

The resilient pivot connection 100 utilizes a resilient member to allow pivoting of the elongate members 74, 76 within the housing 60. In one embodiment, the resilient pivot connection includes dual torsion springs 128, 130, as shown in FIG. 8. The resilient pivot connection 100, elongate members 74, 76, cross bar 88, elongate bent member 114, and short member 118 are all made from a single, integral member to create a resilient deflection subassembly 132. This integral design provides a low-resistance electrical pathway between the electrical conduit 20 connected to the members 114, 118 and into the elongate members 74, 76.

Another feature of the resilient deflection subassembly 132 is that the torsion springs 128, 130 are both located between the elongate members 74, 76. This configuration maximizes the distance between the two spaced point contacts of the elongate members 74, 76 against a tool shaft received in the housing 60. Additionally, the cross bar 88 extends between the elongate members 74, 76 and maintains the members a set distance apart. In one form, curved portions 134, 136 provide a gradual bend between the elongate members 74, 76 and the cross bar 88. The elongate members 74, 76 are preferably long enough so that the cross bar 88 is located between the hook-shaped arms 62, 64 or outside of the housing 60 during pivoting of the elongate members 74, 76. This design limits potential interference between the cross bar 88 and curved portions 134, 136 with features, such as grooves, formed in the shaft of the tool.

Figure 9:
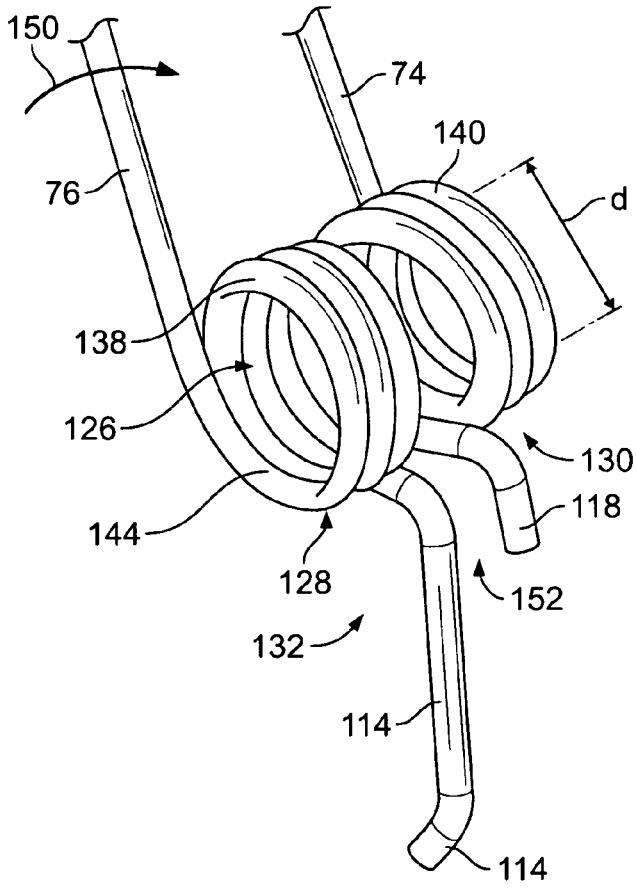
FIG. 9 is a perspective view of the torsion spring of FIG. 8 showing an opening within the coils of the torsion springs.

Torsion springs 128, 130 have sets of coils 138, 140 which generally define a circular opening 126 having an internal diameter d, as shown in FIG. 9. The diameter d is sized to accommodate the pin 72 which passes through opening 126 in coils 138, 140 to fix pivot connection 100 within housing 60. The resilient deflection subassembly 132 also includes curved portions 144 connecting the elongate members 74, 76 to the torsion springs 128, 130. When a tool shaft is placed into the housing opening 84 and deflects elongate members 74, 76 in a direction generally shown by arrow 150, the curved portions 144 transfer the pivoting motion of the elongate members into the torsion springs 128, 130. This causes the torsion springs 128, 130 to wind, which decreases the diameter d of the coils 138, 140. Although the torsion springs 128, 130 shown in FIG. 9 are helically arranged, other types of torsion springs, such as spiral torsion springs, may be used. Additionally, the torsion springs of this embodiment are not intended to be limited to circular cross-sections, and may alternatively be made from wire having other cross sections, such as rectangular.

As can be seen in FIG. 9, the resilient deflection subassembly 132 includes a gap 152 between the elongate bent member 114 and the short member 118. Preferably, the gap 152 is relatively small such the bent member 114 and short member 118 are in close proximity to each other. Although the size of the gap 152 may vary during manufacturing, the effect of variance in the size of the gap 152 is minimized by the process of connecting the resilient deflection subassembly 132 to the exposed end of the electrical conduit 20, such as by clamp 116 shown in FIG. 7.

Referring next to FIGS. 1 and 10-15, usage of the electrical connector 10 herein will be described in further detail. The tip 30 of plug 22 is connected to a corresponding connection on either the signal generator 16 or the nerve monitoring device 12. For purposes of discussion, the plug 22 will be connected to the signal generator 16. The metallic connector within the tip 30 establishes an electrical connection between the electrical conduit 20 and the signal generator 16 so that electrical signals may be conducted to the surgical tool 14.

Figure 10:
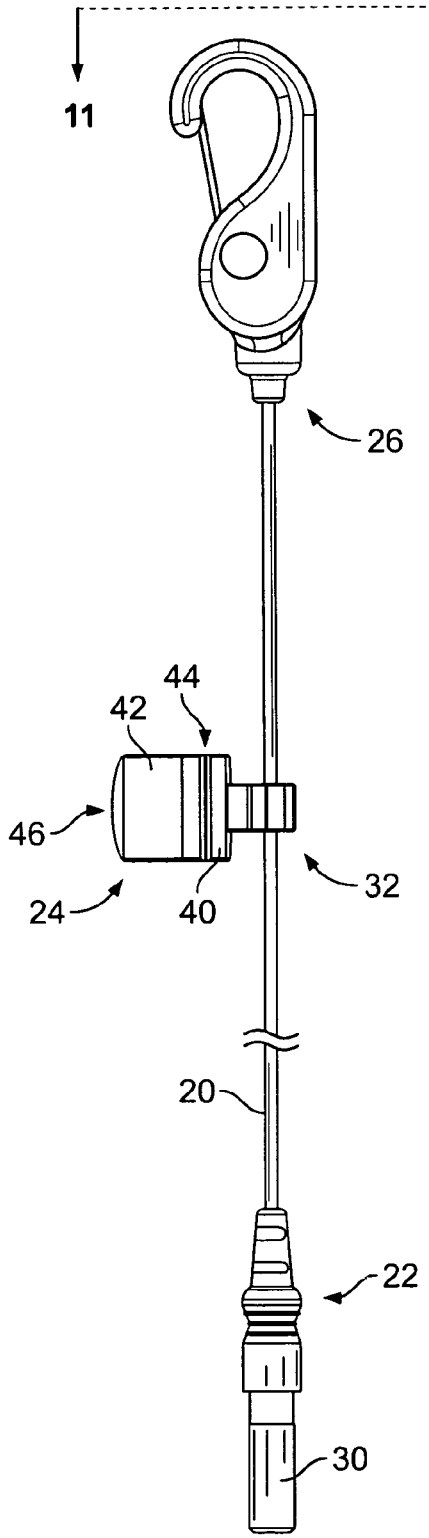
FIG. 10 is a front view of the electrical connector of FIG. 2 showing the elongate members extending across the opening in the housing.

The clip 24 is releasably attached to any point along the electrical conduit 20 by engaging the fastening structure 32 onto the electrical conduit 20, as shown in FIG. 10. Once the clip 24 is secured to the electrical conduit 20, the fastening structure 32 may be further translated by grasping the electrical conduit 20 and pushing the clip 24 along the conduit 20. Such movement temporarily overcomes the resilient engagement forces that keep the fastening structure 32 secured to the electrical conduit 20 and permits the clip 24 to translate relative to the conduit 20.

The position of the clip 24 along the electrical conduit 20 is selected such that when the clip 24 is fixed to an object, the length of electrical conduit extending between the clip 24 and the housing end 26 will permit operation of the tool 14. A competing consideration is that the position should limit the amount of loose electrical conduit 20 that could potentially become tangled within the surgical field. Moreover, the clip 24 is positioned so that there will be tension in the length of the electrical conduit 20 that extends between the clip 24 and the housing end 26 during surgery. This tension in the electrical conduit 22 will tend to resist movement of the housing end 26 away from the clip 24, such as rotation of the housing end 26 about a tool.

To connect the clip 24 to an object, a surgeon compresses contact members 40, 42 together at the second end 46 to overcome the spring force that holds the contact members 40, 42 in clamping engagement at the first end 44. This opens the first end 44 so that the surgeon may place the now spaced contact members 40, 42 onto an object near the surgical field, such as a surgical drape. The surgeon then releases the contact members 40, 42 to allow the spring force of clip 24 to bring the contact members 40,42 into clamping engagement with the object and fix the clip 24 to the object. Although a portion of the electrical conduit 20 is now releasably connected to the object via the clip 24, the pivot connection between the contact member 40 and the fastening structure 32 permits pivoting of the electrical conduit 20 and provides limited mobility to the conduit 20.

Figure 11:
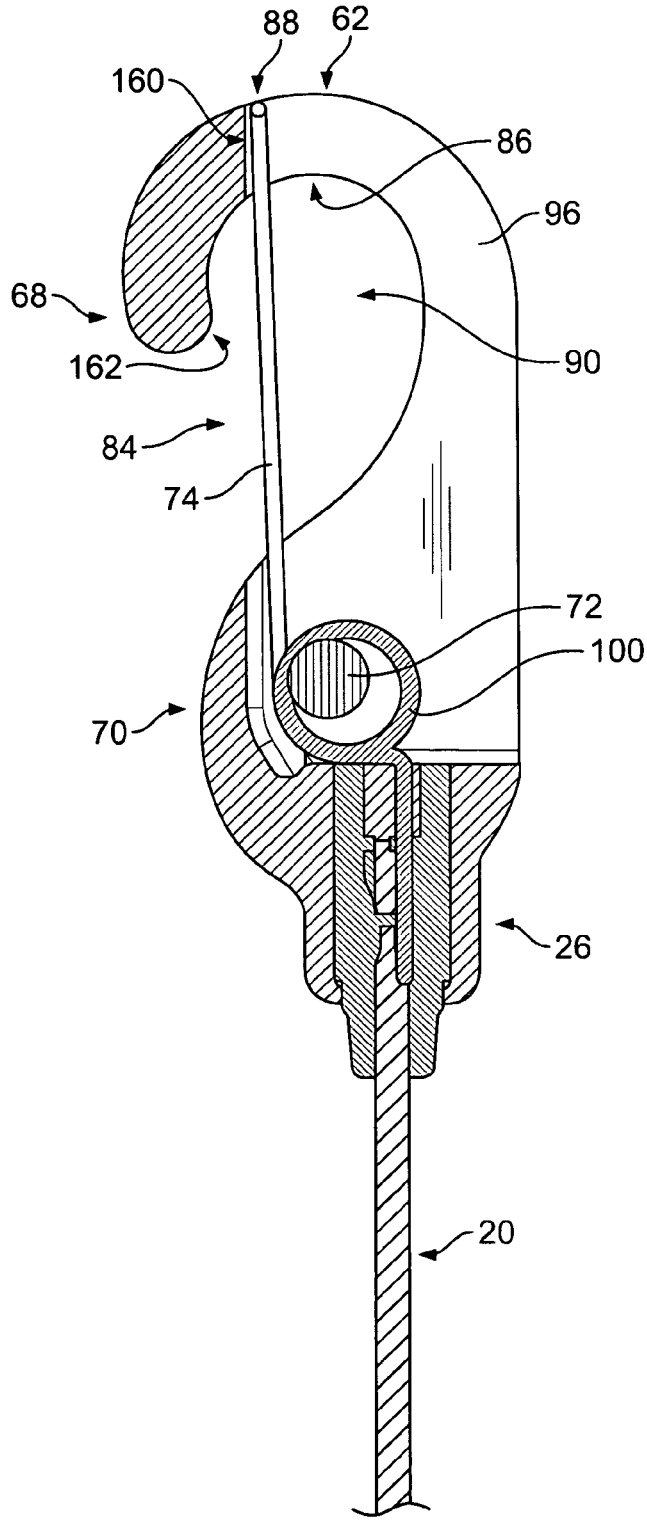
FIG. 11 is an enlarged, cross-sectional view of the housing taken along line 11-11 in FIG. 10 showing an elongate member extending across the opening in the housing and resting against a cross member formed in the housing.

FIG. 11 is a cross-sectional view taken across line 11-11 in FIG. 10, and shows the housing end 26 ready to receive a tool within the opening 90. When the housing end 26 is not engaged with the tool, the elongate member 74 (and elongate member 76 though not shown) extends from the resilient pivot connection 100 across the opening 84 of the housing 60 formed between front section 70 and the ends of hook-shaped arms 62, 64. In this at rest position, the cross bar 88 and portions of the elongate members 74, 76 abut a surface 160 of cross member 68 that extends between the generally flat faces 96, 98 of the hook-shaped arms 62, 64. The support surface 86 of the hook-shaped arms 62, 64 is clearly shown, as well as how the support surface 86 extends along the interior of cross member 68 until reaching a lip 162. At lip 162, the cross member 68 curves back into opening 90 such that support surface 86 tends to trap the shaft of the tool within the housing 60. This is accomplished by partially obstructing the path of the tool shaft through the opening 84 when the tool shaft is positioned against the support surface 86.

Figure 12:
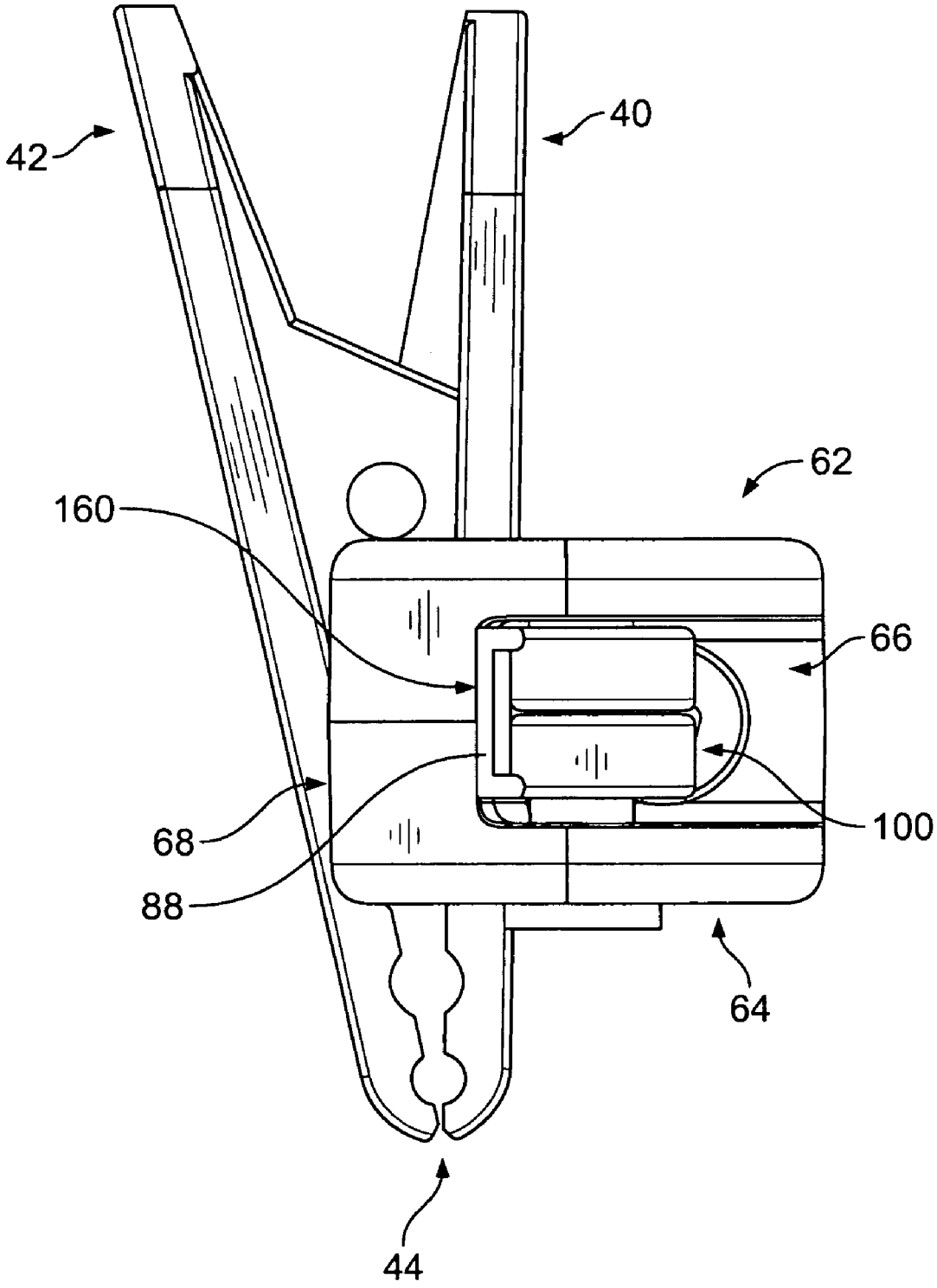
FIG. 12 is a top view of the electrical connector of FIG. 2 showing a cross bar extending between the elongate members resting against a cross member formed in the housing.

In a preferred embodiment, the resilient pivot connection 100 is under a preload that urges the elongate members 74, 76 and cross bar 88 against the surface 160 of cross member 68, as shown in FIG. 12. To create this preload, the resilient deflection subassembly 132 is configured such that the elongate members 74, 76 would extend closer to the lip 162 of the cross member 68 if the surface 160 were removed. However, once the housing end 26 is assembled, the surface 160 acts to deflect the elongate members 74, 76 from their unloaded state which creates a load within the resilient pivot assembly 100. The preload within the resilient pivot assembly 100 permits the elongate members 74, 76 to exert a resilient force against a tool shaft upon contact therewith. Accordingly, the elongate members 74, 76 will urge smaller diameter tool shafts against the support surface 86 even though the smaller tool shafts do not deflect the elongate members 74, 76 within the slot 66 as far as larger diameter tool shafts.

Figure 13:
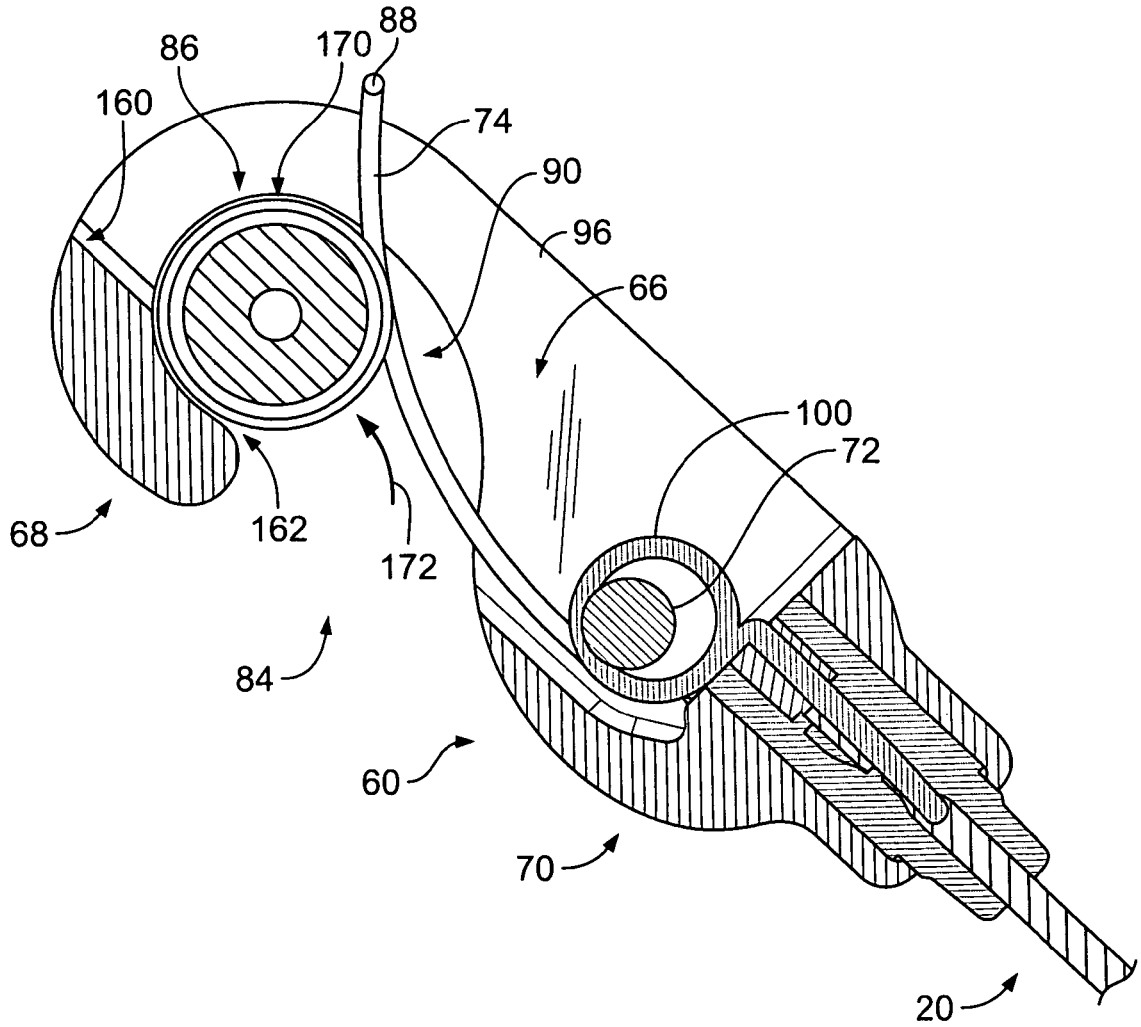
FIG. 13 is an alternative view of the housing of FIG. 11 showing the housing engaged onto a tool shaft and the elongate member deflected within the housing.

As shown in FIG. 13, the housing end 26 may be engaged with a tool shaft 170 before or after the clip 24 fixes a portion of the electrical conduit 20 to an object. The shape of the housing 60 directs the tool shaft 170 into the opening 90 along a curved path, generally shown by arrow 172. As the tool shaft 170 is inserted through opening 84, the tool shaft contacts the elongate members 74, 76 and pivots the members within the slot 66. If the diameter of the tool shaft 170 is sufficiently large, the elongate members 74, 76 will pivot to a position where the cross bar 88 is beyond the housing 60. The pivoting of the elongate members 74, 76 loads the resilient pivot connection 100 and causes the elongate members 74, 76 to apply a resilient force against the tool shaft 170. As the elongate members 74, 76 pivot within the housing 60, the resilient pivot connection 100 tends to move with the elongate members 74, 76. To limit this movement, pin 72 is positioned to brace an inner surface within the opening of the resilient pivot connection 100. The contact between the pin 72 and the resilient pivot connection 100 also creates a fulcrum about which the elongate members 74, 76 pivot.

Engaging the housing 60 onto the tool shaft 170 is a one-handed operation as it only requires shifting the housing 60 onto tool shaft 170 in one fluid movement. More specifically, the housing 60 is placed onto the tool shaft 170 so that the tool shaft 170 enters opening 84 and travels along path 172 until the tool shaft 170 is seated against the support surface 86. The elongate members 74, 76 urge the tool shaft 170 against the support surface 86 throughout the path 172 and continue to apply a resilient force when the tool shaft 170 is seated against support surface 86. The deflection of the elongate members 74, 76 and the resulting load on the resilient pivot member 100 produces the engagement of the elongate members 74, 76 against the tool shaft 170 which attaches the housing 60 to the tool shaft 170.

Once the tool shaft 170 is seated against the support surface 86 within the housing 60, the elongate members 74, 76 hold the tool shaft 170 in place by urging the tool shaft 170 against the support surface 86. In effect, there are two different types of contact against the shaft that provide a friction force which retains the housing end 26 on the tool shaft 170. The first type of contact is between the support surface 86 and the tool shaft 170. Whether the tool shaft 170 is contacting the cross member 68 or the spaced hook-shaped arms 62, 64, the contact is generally between a smooth, curved surface that is complimentary to the curvature of the outer surface of the tool shaft. The second type of contact is between the tool shaft 170 and the elongate members 62, 64 that extend transverse to the length of the tool shaft 170. This transverse orientation, coupled with the relatively thin cross section of the elongate members 62, 64, provides a point contact between each spaced, elongate member 62, 64 and the tool shaft 170. Thus, the housing end 26 engages the tool shaft 170 at one line contact at the support surface 86 and two spaced, point contacts at the elongate members 62, 64. These contacts generate friction forces that are sufficient to hold the housing end 26 on the tool shaft 170, but which permit rotation of the tool shaft 170 relative to the housing end 26. Additionally, the elongate members 62, 64 may be received within grooves formed in the tool shaft 170 to further resist movement of the housing 60 along the tool shaft 170.

Figure 14:
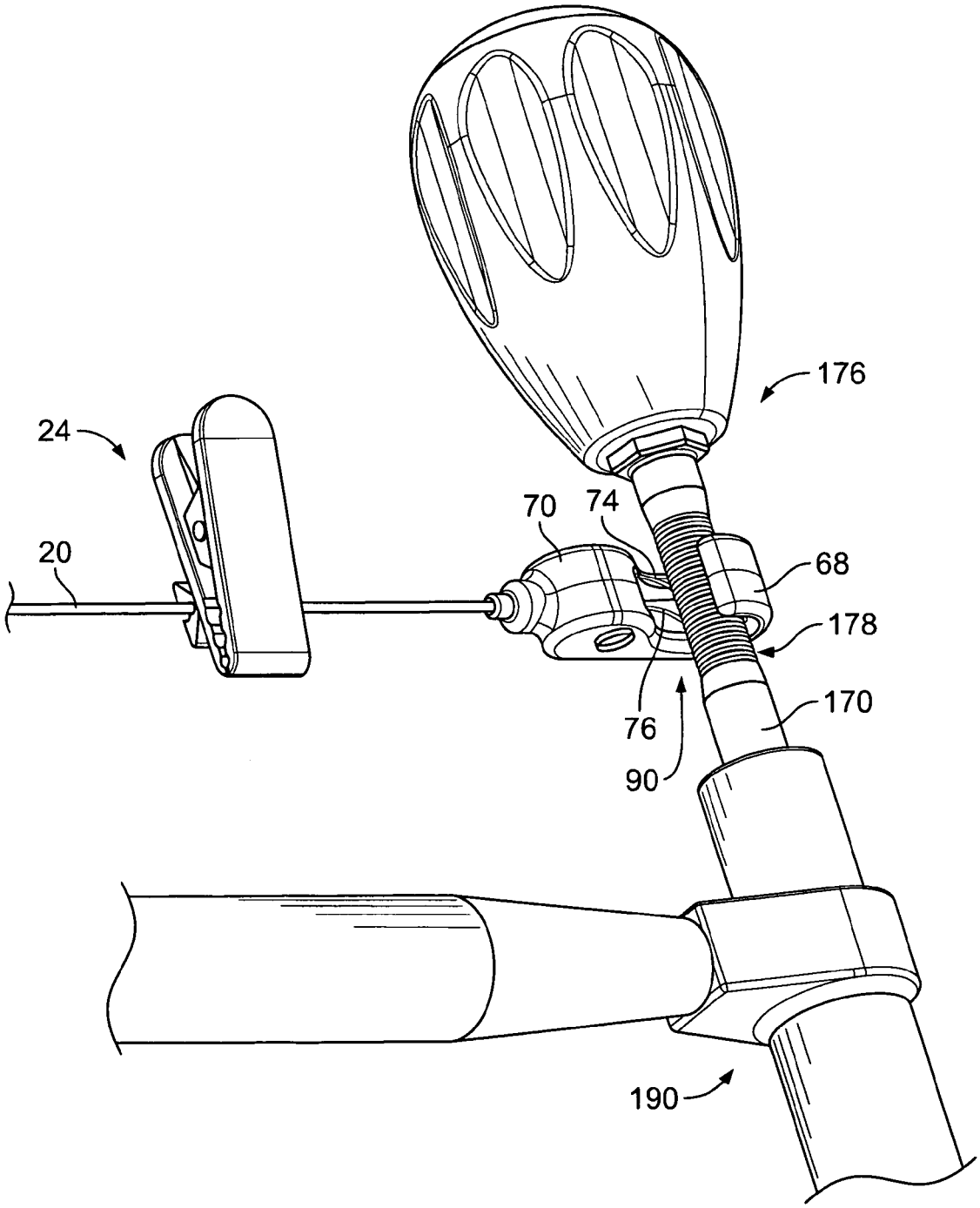
FIG. 14 is a perspective view of the electrical connector of FIG. 2 secured to a tool with the elongate members engaging grooves formed on the tool shaft.
Figure 15:
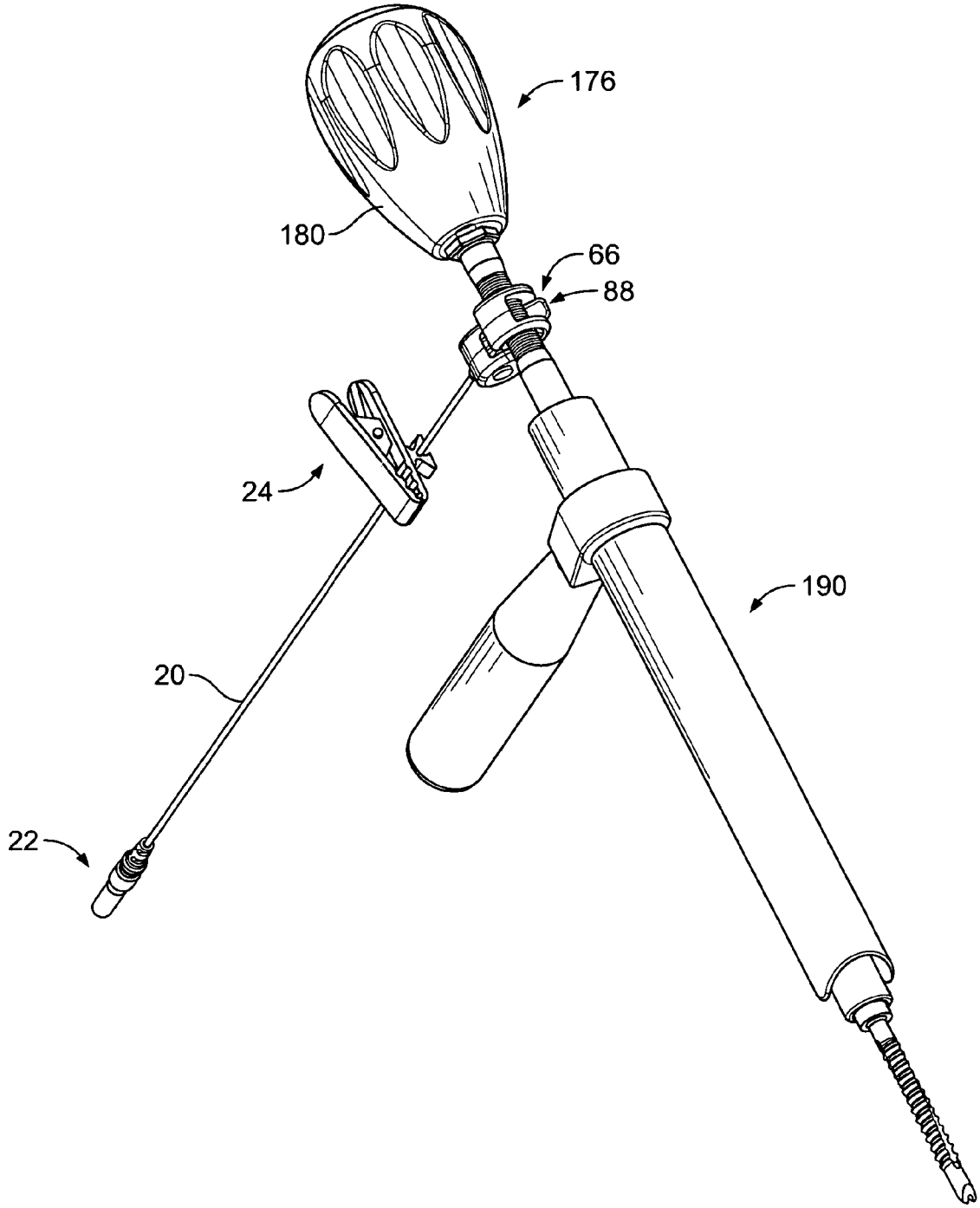
FIG. 15 is a perspective view of the electrical connector and tool of FIG. 14 showing the elongate members deflected backward within the housing.

With the housing end 26 engaged with the shaft 170 of tool 176, the surgeon is able to perform nerve monitoring by using the signal generator 16 to energize the tool shaft 170. The electrical signal is transmitted from the plug 22, along the electrical conduit 20, and eventually into the tool shaft 170 through the elongate members 74, 76. The electrical connector 10 may be used with a variety of surgical tools, but FIGS. 14 and 15 show a combination awl and tap tool 176 for tapping a hole formed in a bone. Preferably, a non-conductive docking sleeve 190 extends into an incision formed in the patient and is adjacent to the target bone. The docking sleeve 190 insulates the energized tool 176 from the fluids and tissues in the patient's body that may permit the electrical signal to travel away from the energized tool and hinder nerve monitoring.

As shown in FIG. 14, the tool 176 is inserted into the docking sleeve 190 until the tool 176 contacts the bone. Previously, the clip 24 was secured to a fixed object so that the electrical conduit 20 was tensioned between the clip 24 and the housing end 26. When the surgeon begins to tap the hole in the bone by rotating the tool 176, the tension in the electrical conduit 20 resists rotation of the housing end 26. This overcomes the friction forces which exist between the tool shaft 170, support surface 86, and elongate members 74, 76, thereby allowing the housing end 26 to remain relatively stationary while the tool 176 rotates.

Once the surgeon has completed the awl operation, the tool 176 is removed from the docking sleeve 190. The housing end 26 is then removed from engagement with the tool shaft 170 by moving the tool shaft 170 along a path generally opposite the path shown by arrow 172 in FIG. 13. This path involves separating the tool shaft 170 from the support surface 86 and directing the tool shaft 170 around lip 162. As the tool shaft 170 travels toward the opening 84, the elongate members 74, 76 continue to contact the tool shaft 170 and resist movement of the shaft 170 from the support surface 86. After the housing end 26 is disengaged from tool 176, the housing end 26 may be connected to a different tool, such as a screwdriver, to drive a screw into the bone.

While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

What is claimed is:

1. A device for creating an electrical connection between a nerve monitoring device and a tool having a metallic shaft for being rotated, the device comprising:

a body of nonconductive material having a fixed bearing surface configured to engage the rotatable tool shaft;

an elongate flexible conductor having a first end connected to the body and a second end configured to be connected to the nerve monitoring device; and a pair of spaced, electrical contact members of conductive material and being connected to the body with the electrical contacts being configured so that the contacts have point contact with the tool shaft to provide two spaced points of contact therewith minimizing friction between the contacts and tool shaft during rotation of the tool shaft.

2. The device of claim 1 wherein the pair of electrical contact members comprise a pair of thin, straight spring wire members that extend parallel to each other.

3. The device of claim 1 wherein the bearing surface has an arcuate configuration that extends about an axis thereof, and the electrical contact members have an elongate configuration and extend transverse to the axis.

4. The device of claim 1 wherein the electrical contact members include a resilient pivot connection that is operable to bias the spaced, electrical contact members against the tool shaft and urge the tool against the bearing surface to securely hold the tool therebetween.

5. The device of claim 4 wherein the resilient pivot connection is positioned between the electrical contact members to maximize the distance between the two spaced points of contact along the tool shaft.

6. The device of claim 1 in combination with the tool wherein the tool shaft has grooves formed therein, and the spaced, electrical contact members are sized to fit within the grooves of the tool shaft to limit movement of the body along the tool shaft during rotation thereof.

7. The device of claim 1 wherein the elongate flexible conductor includes a clip mounted thereon for clipping the flexible conductor to a fixed structure to create tension in the portion of the conductor extending between the clip and the body for resisting rotation of the body during rotation of the tool.

8. A device for providing an electrical connection to tools having shafts of varying diameters, the device comprising:

a rigid housing having a support surface configured to engage a tool shaft;

a contact arm of conductive material configured to engage the tool shaft and urging the tool shaft against the support surface so that the tool shaft is securely held therebetween;

a resilient pivot connection between the contact arm and the housing to allow the contact arm to resiliently pivot for engaging tool shafts of varying diameters; and a slot of the rigid housing disposed to allow the contact arm to pivot therein and beyond the housing for allowing larger diameter tool shafts to be securely held between the housing support surface and the contact arm.

9. The device of claim 8 wherein the contact arm includes a pair of spaced, thin elongate members oriented in a parallel relationship such that the spaced, thin elongate members contact the tool shaft at two spaced points a predetermined distance apart that stays the same regardless of the diameter of the tool shaft engaged thereby.

10. The device of claim 8 wherein the contact arm and the resilient pivot connection comprise a double torsion spring so that the contact arm comprises a pair of spaced contact arms of the spring and the pivot connection comprises coils of the spring positioned between the contact arms to maximize the spacing between the arms to provide a secure electrical connection between the contact arms and the tool shaft.

11. The device of claim 8 wherein the rigid housing has an opening adjacent the support surface thereof, the contact arm extends across the housing opening, and the pivot connection is operable to allow the tool shaft to resiliently pivot the contact arm as the shaft is inserted through the housing opening into engagement with the support surface with the pivoted contact arm resiliently urging the tool shaft against the support surface.

12. The device of claim 8 wherein the rigid housing has two hook-shaped portions extending on either side of the housing slot and being configured to extend around the tool shaft.

13. The device of claim 12 wherein the hook-shaped portions include free ends interconnected by a shaft support portion including the support surface, and the resilient pivot connection is preloaded to bias the contact arm against the support portion so that smaller diameter tool shafts are securely held between the housing support surface and the contact arm.

14. The device of claim 8 wherein the resilient pivot connection has spring coils that decrease in diameter as the contact arm pivots away from the support portion.

15. An electrical connection head for being secured to a conductive tool shaft for establishing an electrical connection thereat, the electrical connection head comprising:

a rigid housing having a support surface;

an opening of the housing sized for receiving the tool shaft therethrough; and a contact arm resiliently mounted to the housing so that the contact arm extends across and closes the housing opening in a closed position thereof, and resiliently shifts to an open position as the contact arm is brought into engagement with the tool shaft to open the housing opening sufficiently to allow the tool shaft to be received through the housing opening and to be biased into engagement with the support surface by the resiliently shifted contact arm such that attachment of the electrical connection head to the tool shaft only requires a one-handed operation.

16. The electrical connection head of claim 15 wherein the contact arm comprises two thin, elongate members that both extend across and close the housing opening with each member providing point contact against the tool shaft such that the contact arm is biased against into engagement with the tool shaft at two spaced points to urge the tool shaft against the support surface of the rigid housing.

17. The device of claim 15 wherein the rigid housing has a hook-shaped portion defining the housing opening and configured to extend around the tool shaft with the shaft biased against the support surface.

18. The electrical connection head of claim 15 wherein the contact arm and the housing have a resilient pivot connection therebetween with the resilient pivot connection and housing opening oriented and configured so that the tool shaft is inserted through the opening in a direction that is transverse to a biasing direction the resilient pivot connection provides to the resilient contact arm.

19. The device of claim 15 wherein the contact arm is preloaded to engage against the housing adjacent the support surface in the closed position so that smaller diameter tool shafts are securely held between the housing support surface and the contact arm.

* * * * *